US009970440B2

(12) United States Patent
Zhu

(10) Patent No.: US 9,970,440 B2
(45) Date of Patent: May 15, 2018

(54) SCREW COMPRESSOR WITH ADJUSTABLE INTERNAL VOLUME RATIO

(71) Applicants: JOHNSON CONTROLS TECHNOLOGY COMPANY, Holland, MI (US); JOHNSON CONTROLS AIR CONDITIONING AND REFRIGERATION (WUXI) CO., LTD., Wuxi, Jiangsu (CN)

(72) Inventor: Yu Zhu, Jiangsu (CN)

(73) Assignees: Johnson Controls Technology Company, Auburn Hills, MI (US); Johnson Controls Air Conditioning and Refrigeration (Wuxi) Co. Ltd., Jiangsu (CN)

( * ) Notice: Subject to any disclaimer, the term of this patent is extended or adjusted under 35 U.S.C. 154(b) by 204 days.

(21) Appl. No.: 14/797,324

(22) Filed: Jul. 13, 2015

(65) Prior Publication Data

US 2016/0084251 A1 Mar. 24, 2016

(30) Foreign Application Priority Data

Sep. 23, 2014 (CN) ..... 2014 2 0548889 U

(51) Int. Cl.

| | |
|---|---|
| ***F02B 33/44*** | (2006.01) |
| ***F02B 33/00*** | (2006.01) |
| ***F01C 1/16*** | (2006.01) |
| ***F04C 18/00*** | (2006.01) |
| ***F04C 2/00*** | (2006.01) |
| ***F04C 28/12*** | (2006.01) |
| ***F04C 18/16*** | (2006.01) |

(52) U.S. Cl.
CPC ..... *F04C 28/125* (2013.01); *F04C 18/16* (2013.01)

(58) Field of Classification Search
CPC ..... F04C 28/125; F04C 28/12; F01C 20/12
USPC ..... 418/201.2
See application file for complete search history.

(56) References Cited

U.S. PATENT DOCUMENTS

| | | | | |
|---|---|---|---|---|
| 4,388,048 | A * | 6/1983 | Shaw | F04C 28/125 417/299 |
| 4,575,323 | A * | 3/1986 | Yoshimura | F04C 28/125 417/440 |
| 5,018,948 | A * | 5/1991 | Sjtöholm | F04C 28/125 417/302 |
| 6,276,911 | B1 * | 8/2001 | Krusche | F04C 28/125 418/201.2 |
| 6,302,668 | B1 * | 10/2001 | Lee | F04C 28/12 418/201.2 |
| 7,588,430 | B2 * | 9/2009 | Hasegawa | F04C 28/125 418/201.1 |
| 8,221,104 | B2 * | 7/2012 | Wilson | F04C 28/12 417/310 |

* cited by examiner

*Primary Examiner* — Mark Laurenzi
*Assistant Examiner* — Anthony Ayala Delgado
(74) *Attorney, Agent, or Firm* — Fletcher Yoder, P.C.

(57) ABSTRACT

A screw compressor is provided having adjustable internal volume ratio, including a body and a male rotor, a female rotor and a slide valve configured inside the body, a groove being configured at one side of the male rotor and the female rotor, and the slide valve being configured inside the groove with the slide valve movable inside the groove from a first position corresponding to a minimum internal volume ratio to a second position corresponding to a maximum internal volume ratio.

10 Claims, 4 Drawing Sheets

SCREW COMPRESSOR WITH ADJUSTABLE INTERNAL VOLUME RATIO

FIELD OF THE INVENTION

The present invention involves the field of refrigeration air conditioner, in particular a screw compressor having adjustable internal volume ratio.

BACKGROUND OF THE INVENTION

A screw compressor is widely applied in the field of refrigeration air conditioners due to its wide application scope and high reliability. According to application requirements, a single screw compressor often runs under various working conditions, for instance cold water and ice making working conditions of an ice-storage dual-working-condition unit, or cold water and hot water making working conditions of a heat pump unit, or even triple-working-conditions required to make ice, cold water and hot water.

Different application working conditions require different compressor internal volume ratios Vi, wherein: Vi=Vs/Vd, Vs refers to an intertooth volume when the screw compressor finishes suction and starts compression; Vd refers to an intertooth volume when the screw compressor finishes compression. It is well-known when design Vi of the screw compressor is equal to system Vi', the screw compressor provides optimal performance and operation state, and at this moment, vibration level of the screw compressor is comparatively low ensuring its reliability. Wherein, system Vi'=(Pd/Ps)^(1/k); Pd refers to pressure at an exhaust end of the compressor; Ps refers to pressure at an suction end of the compressor; k refers to adiabatic exponent of compression media.

According to the design types of Vi, a screw compressor can be screw compressor with fixed Vi or screw compressor with adjustable Vi.

With respect to a screw compressor with fixed Vi, FIG. 1 and FIG. 2 illustrate the diagrammatic sketches of the screw compressor with fixed Vi respectively corresponding to low Vi design and high Vi design. It can be seen from the sketches that with adjustment of length of a slide valve 3, various requirements of design Vi are able to be achieved. For such a type of screw compressor, the main function of the slide valve 3 is to adjust efficient air volume, and Vi of the screw compressor is basically fixed and automatic matching of system Vi' is not possible. It is designed aiming at only one working condition, and when it runs under the design working condition, Vi=Vi', the efficiency of the compressor is supreme. In addition, according to various application working conditions, it is needed to select different design Vi of the screw compressor, for instance under cold water making working condition, design Vi of the screw compressor is usually $_{1.7\sim2.6}$, under heating or ice-storage working condition, design Vi of the screw compressor is usually 3.0~4.0 and for refrigeration or high temperature heat pump application, design Vi of the screw compressor reaches 3.5~5.0. Taking a screw compressor with R134a heat pump for example, under cooling working condition, the temperature of yielding water of its evaporator is 7° C. and of its condenser is 35° C.; under heating working condition, the temperature of yielding water of its evaporator is 7° C. and of its condenser is 55° C. Calculation of system Vi: under cooling working condition, Vi'=2.3; under heating working condition Vi'=3.5. Therefore, for fixed Vi compressor selection, it is only able to select a single design Vi between 2.3 or 3.5, and is not in a position to satisfy the requirements of system Vi' for both cooling and heating conditions; if design Vi of the compressor is selected as 2.3, the level of vibration of the compressor under heating working condition will be too high, affecting service life of the compressor; if design Vi of the compressor is selected as 3.5, COP of the compressor under cooling working condition will decay 10%~15% compared with that of the compressor with 2.3 design Vi.

With respect to a screw compressor with adjustable Vi, FIG. 3 illustrates a common screw compressor with adjustable Vi at present, which adds a Vi adjusting block 4 on the basis of a slide valve 3; with the action of the Vi adjusting block 4, adjustment of Vi is realized, and thus matching between Vi of compressor and system Vi' is achieved, which enables high efficient operation of the compressor. However, the limitation of the compressor with such a design is: due to the additional Vi adjusting block 4, the structure of the compressor becomes complicated and the manufacture costs are increased, which blocks its popularization in air conditioner system (cooling/heating/ice-storage) application; when the compressor runs with high Vi, since the Vi adjusting block 4 occupies most of room of a screw rotor, with increase of Vi, capacity adjustment ability of the slide valve 3 of the compressor is obviously decreased, resulting in the issue of discontinuous adjustment over loads and poor ability of adjustment over a part of loads. When the compressor runs with high Vi, the adjustable region by the slide valve is shortened, ability of adjustment over a part of loads becomes poor, and discontinuous adjustment of capacity occurs, for instance at 100%~60% load region, the slide valve is not able to do adjustment, and the higher Vi is, the poorer capacity adjustment ability will be.

SUMMARY OF THE INVENTION

The present invention is directed to a screw compressor with adjustable internal volume ratio, including a body and a male rotor, a female rotor and a slide valve configured inside said body, a groove being configured at one side of said male rotor and said female rotor, said slide valve being configured inside said groove, wherein said slide valve is able to move inside said groove from a first position corresponding to a minimum internal volume ratio to a second position corresponding to a maximum internal volume ratio.

Optionally, said slide valve is able to move to a third position corresponding to a middle internal volume ratio between said first position and said second position.

Optionally, said female rotor and said male rotor have a suction end and an exhaust end, said slide valve has a first end and a second end, with said first end next to said suction ends and said second end next to said exhaust ends, and a radial exhaust port being configured at said second end of said slide valve.

Optionally, said first position is a position where said first end extends outside said suction ends, while said second end does not extend outside said exhaust ends, said second position is a position where said first end is level with said suction ends, and said slide valve is entirely wrapped between said female rotor and said male rotor.

Optionally, at said third position, said first end extends outside said suction ends.

Optionally, said slide valve is driven by high pressure oil.

Optionally, said screw compressor with adjustable internal volume ratio includes a hydraulic cylinder with an adjusting piston connected to said slide valve being configured inside said hydraulic cylinder.

Optionally, said hydraulic cylinder is connected to an oil pipeline, which is connected to a suction cavity of said screw compressor, an upload magnetic valve and an unload magnetic valve being configured on said oil pipeline, and a first adjusting opening and a second adjusting opening being configured on said hydraulic cylinder, with said first adjusting opening and said second adjusting opening being connected to said magnetic valves.

Optionally, the length of said slide valve is determined by a maximum internal volume ratio required by said screw compressor.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

In the descriptions of the following paragraphs, plenty of specific details are provided to enable in-depth understanding of the present invention. However, it is obvious for those skilled in art that the present invention is able to be implemented without one or more details of such. In other examples, to avoid confusion with the present invention, some technical features known to the public in this field are not described.

In order to thoroughly understand the present invention, the detailed structures will be put forward in the following descriptions. It is obvious that the implementation of the embodiments of the present invention is not limited to the special details familiar to those skilled in art. Preferable embodiments of the present invention are detailed below. However, apart from such detailed descriptions, the present invention is able to have other embodiments.

Figure 5:
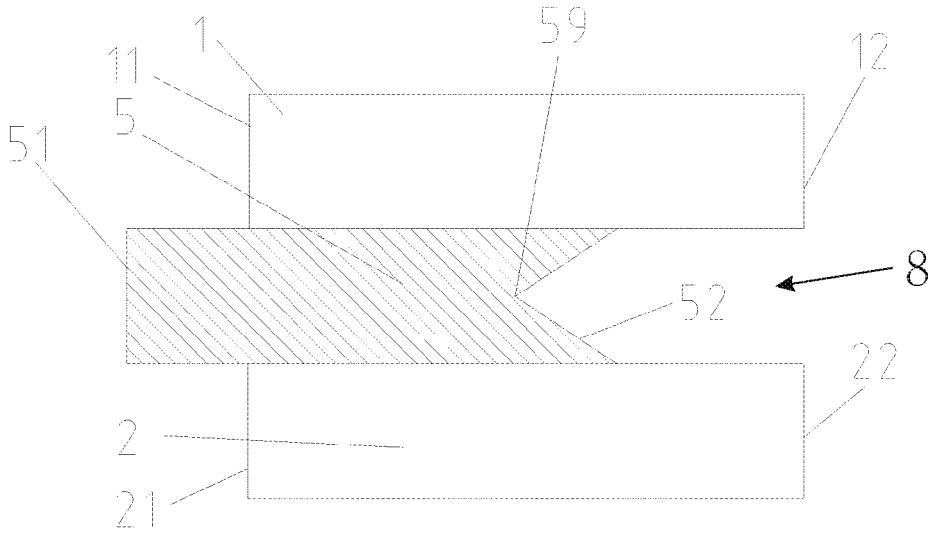
FIG. 5 is diagrammatic sketch of a slide valve (first position) of a screw compressor with adjustable internal volume ratio of the present invention.

As shown in FIG. 5, the present invention discloses a screw compressor with adjustable internal volume ratio, comprising a body and a male rotor 1, a female rotor 2 and a slide valve 5 configured inside said body, a groove 8 being configured along axial of the male rotor 1 and the female rotor 2 and the groove 8 containing the slide valve 5, and the slide valve 5 is able to move inside the groove 8 from a first position to a second position, and the slide valve 5 provides changeable internal volume ratio and capacity to the screw compressor with adjustable internal volume ratio, and the length of the slide valve 5 is determined by a maximum internal volume ratio required by the screw compressor, and when the slide valve 5 is at the first position, internal volume ratio is minimum, while at the second position, internal volume ratio is maximum, and the slide valve is able to move to a third position between the first position and the second position to provide a middle internal volume ratio.

Figure 1:
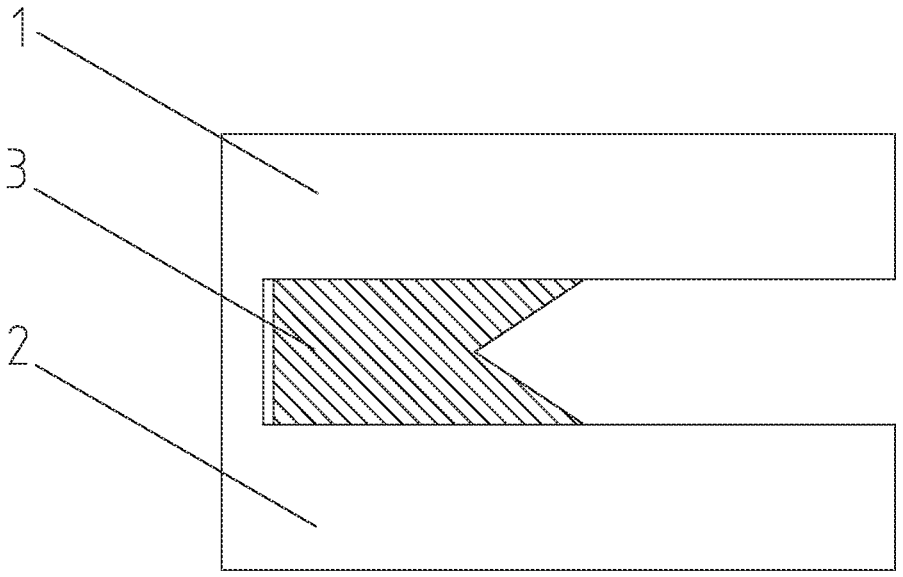
Fig.1 PRIOR ART
FIG. 1 is a diagrammatic sketch of a slide valve of a compressor with fixed low internal volume ratio.
Figure 2:
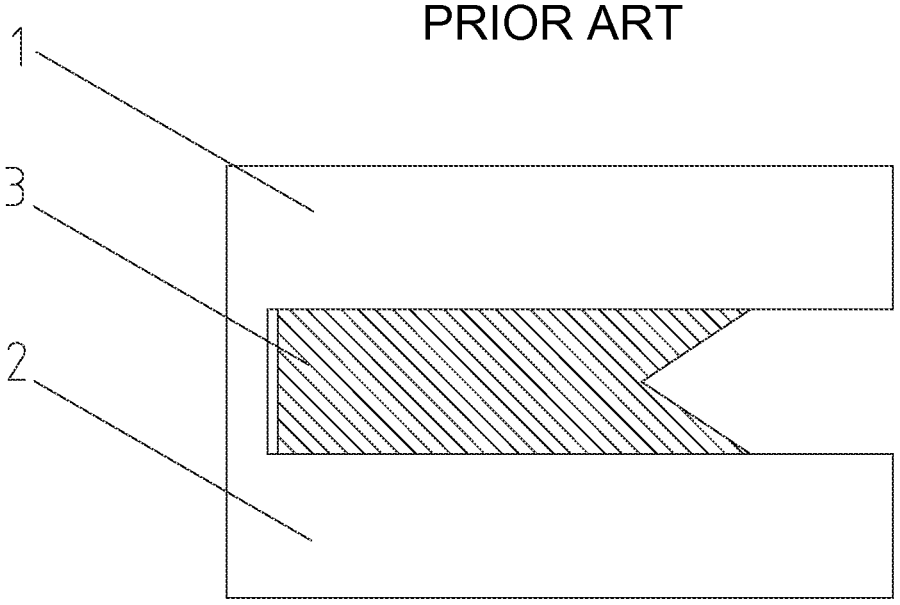
Fig.2 PRIOR ART
FIG. 2. is a diagrammatic sketch of a slide valve of a compressor with fixed high internal volume ratio.
Figure 3:
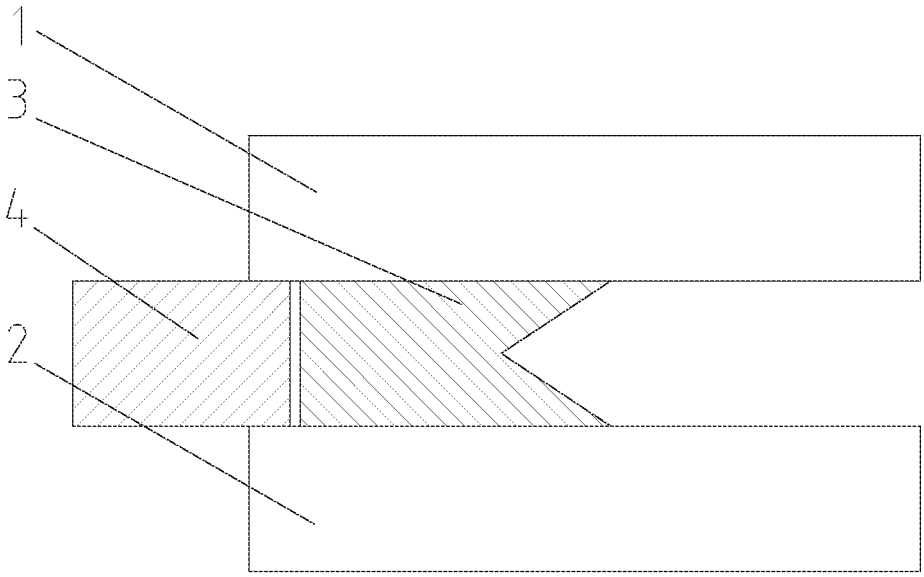
Fig.3 PRIOR ART
FIG. 3 is a diagrammatic sketch of a slide valve of a compressor at low Vi position with adjustable internal volume ratio.
Figure 4:
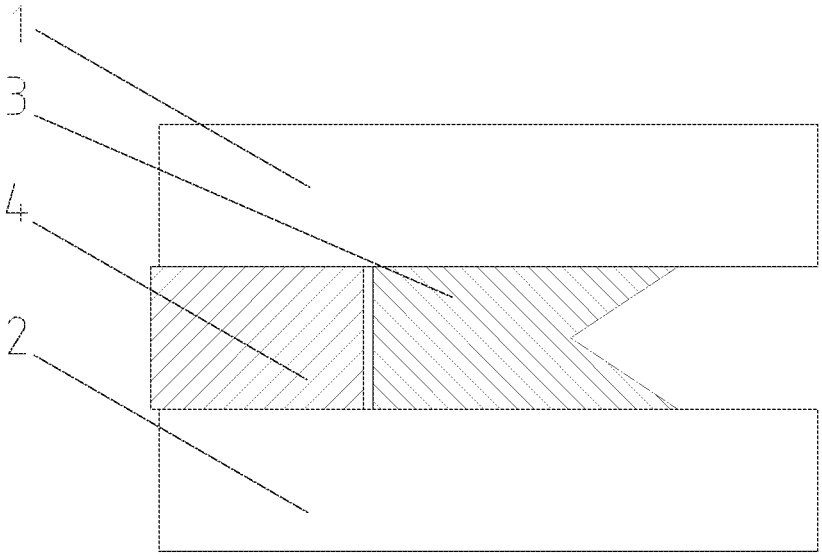
Fig.4 PRIOR ART
FIG. 4 is a diagrammatic sketch of a slide valve of a compressor at high Vi position with adjustable internal volume ratio.

The screw compressor with adjustable volume ratio of the present invention integrates the functions of an internal volume ratio adjusting block 4 (FIG. 3) and a slide valve 3 (FIG. 3) designed for a compressor with adjustable volume ratio, and is able to achieve adjustment of internal volume ratio and loads of the compressor so that the issues, like complicated structure, high creation costs and discontinous adjustment of loads caused by addition of a Vi adjusting block in the screw compressor with adjustable Vi are able to be solved.

With the slide valve of the present invention, continuous adjustment of internal volume ratio and capacity of the screw compressor is achieved, and it becomes easy for control, comparative with fixed internal volume ratio screw compressor in terms of manufacture cost and satisfies the requirements of application of a screw compressor under multiple design working conditions. Under any working Vi, it is in a position to achieve continuous adjustment of capacity of the screw compressor, from 100% load to a minimum load, which is determined by the design of the compressor, and able to apply to all screw compressor adopting slide valve adjustment.

Optionally, the rotor has a suction end and an exhaust end, specifically, the male rotor 1 has a male rotor suction end 11 and a male rotor exhaust end 12, while the female rotor 2 has a female rotor suction end 21 and a female rotor exhaust end 22. The slide valve has a first end 51 and a second end 52, the first end 51 next to the suction ends, and the second end 52 next to the exhaust ends. A radial exhaust port 59 is configured at the second end 52 of the slide valve.

Figure 6:
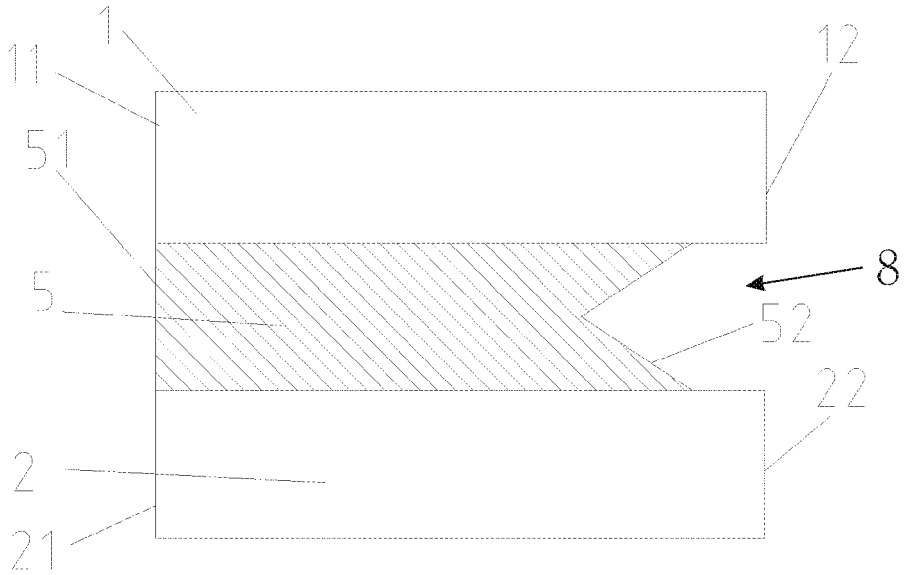
FIG. 6 is diagrammatic sketch of a slide valve (second position) of a screw compressor with adjustable internal volume ratio of the present invention.

Optionally, as shown in FIG. 5, the first position is a position where the first end 51 extends outside the suction ends, and as shown in FIG. 6, the second position is a position where the first end 51 is level with the suction ends. In an optional embodiment, at the first position, a part of the slide valve 5 is outside the suction ends of the rotors, and at this moment, the section of the slide valve 5 extending outside does not function for wrapping the compression cavity of the male rotor 1 and female rotor 2. During the movement from the first position to the second position, as shown in FIG. 6, when the slide valve moves to the second position, the entire slide valve 5 functions for wrapping the compression cavity of the male rotor 1 and female rotor 2, and Vi reaches the maximum value. During the movement from the first position to the second position, the slide valve 5 moves towards the exhaust ends, and Vi of the screw compressor is increasing, and when the slide valve 5 arrives at the second position, Vi of the screw compressor reaches the maximum value.

The region between the first position and the second position is an adjustable range of internal volume ratio: by adjusting the position of the slide valve 5, any internal volume ratio of the compressor between the minimum internal volume ratio and the maximum internal volume ratio is able to be achieved to satisfy various system Vi' requirements.

Optionally, where the first end of the slide valve 5 is ensured to be level with the suction ends of the female and male rotors, the length of the slide valve 5 is determined by the maximum of the internal volume ratio required by the screw compressor.

Optionally, the slide valve is driven by high pressure oil.

Figure 7:
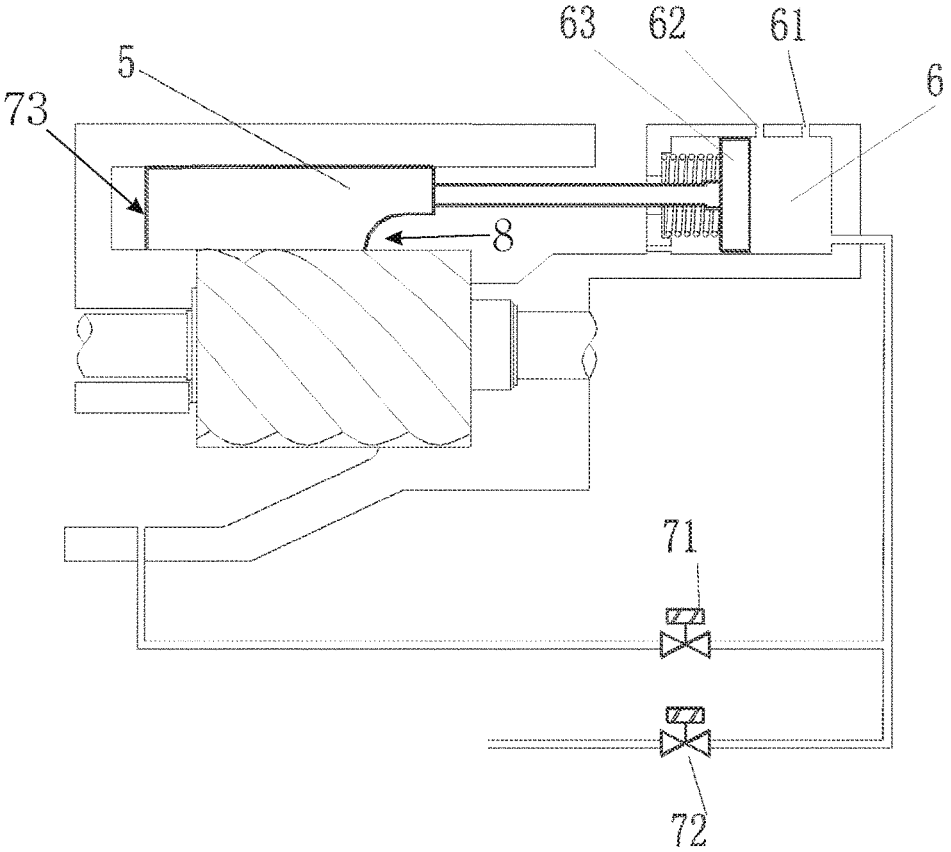
FIG. 7 is diagrammatic sketch of a screw compressor with adjustable internal volume ratio of the present invention.

Further optionally, as shown in FIG. 7, the screw compressor with adjustable internal volume ratio comprises a suction cavity and a hydraulic cylinder 6 with an adjusting piston 63 connected to the slide valve being configured inside the hydraulic cylinder 6, and the hydraulic cylinder 6 is connected to an oil pipeline, which comprises an unload oil pipeline and an upload oil pipeline, with an unload magnetic valve 71 being configured on the unload oil pipeline and an upload magnetic valve 72 being configured on the upload oil pipeline, and a first adjusting opening 61 and a second adjusting opening 62 being configured on the hydraulic cylinder 6, with first adjusting opening 61 and said second adjusting opening being 62 connected to the magnetic valves. Additionally, as shown, the slide valve 5 is positioned in a third position 73 corresponding to a middle internal volume ratio between the first position shown in FIG. 5 and the second position shown in FIG. 6.

In an optional embodiment of the present invention, when the unload magnetic valve 71 is opened, the slide valve 5 moves towards right direction (the upload magnetic valve 72 is closed at this moment), and when the upload magnetic valve 72 is opened, the slide valve 5 moves towards left direction (the unload magnetic valve 71 is closed at this moment), and the first adjusting opening 61 and the second adjusting opening 62 are adjusting openings for internal volume ratio, the exterior pipelines of which are connected to the suction cavity of the compressor with magnetic valves being configured on the pipelines to control switching.

The screw compressor of the present invention realizes adjustment of internal volume ratio as follows:

Minimum internal volume ratio: open the upload magnetic valve 72, and close the unload magnetic valve 71 as well as the magnetic valves on the connecting pipes of the first adjusting opening 61 and the second adjusting opening 62, and the screw compressor is uploaded to full-load, at this moment the slide valve 5 is at the left end and the compressor corresponds to the minimum internal volume ratio.

Middle internal volume ratio: open the magnetic valve (without indication) connected to the second adjusting opening 62, and rest of the magnetic valves are closed, and the slide valve 5 moves towards right side until the second adjusting opening; at this moment, internal volume ratio of the compressor is between the maximum and minimum values of internal volume ratio; those skilled in art should know that the specific value of internal volume ratio at this position is able to be calculated by design of the position of the slide valve 5; in like manner, according to different positions of the second adjusting opening 62, different middle internal volume ratios are able to be obtained.

Maximum internal volume ratio: open the magnetic valve (without indication) connected to the first adjusting opening 61, and rest of the magnetic valves are closed, and the slide valve 5 continues to move towards right side, when the slide valve 5 arrives at the first adjusting opening 61, the slide valve 5 entirely enters into the region of the rotors, and at this moment the compressor is at the second position so that the maximum internal volume ratio is obtained.

With respect to compressor capacity adjustment, those skilled in art should understand that with combination control by the unload magnetic valve 71 and the upload magnetic valve 72, same as the existing design of the compressor with fixed internal volume ratio, adjustment of capacity of the compressor is able to be achieved.

The screw compressor with adjustable internal volume ratio of the present invention, with the slide valve, continuous adjustment of internal volume ratio and capacity of the screw compressor is achieved, and it becomes easy for control, comparative with fixed internal volume ratio screw compressor in terms of manufacture cost, and satisfies the requirements of application of a screw compressor under multiple design working conditions, such as cooling condition and heating condition on heat pump unit.

The present invention has been illustrated by aforesaid embodiments, but it should be understood that aforesaid embodiments are only for exampling and illustration rather than being intended to limit the present invention within the scope of the embodiments described. In addition, those skilled in art are in a position to understand that the present invention is not limited to aforesaid embodiments, and according to the instructions of the present invention, various variants and modifications are able to be obtained, and such variants and modifications fall into the scope claimed for protection of the present disclosure.

What is claimed is:

1. A screw compressor having an adjustable internal volume ratio, wherein the screw compressor comprises:

a body;

a male rotor;

a female rotor;

a slide valve inside the body; and a groove being configured at one side of the male rotor and the female rotor, wherein the slide valve is configured inside the groove, wherein the slide valve is able to move inside the groove from a first position corresponding to a minimum internal volume ratio to a second position corresponding to a maximum internal volume ratio, wherein the slide valve comprises a first end disposed next to respective suction ends of the male rotor and the female rotor, and wherein in the second position, the first end of the slide valve is flush with the suction ends of the male rotor and the female rotor.

2. The screw compressor with the adjustable internal volume ratio according to claim 1, wherein the slide valve is able to move to a third position corresponding to a middle internal volume ratio, and wherein the third position is between the first position and the second position.

3. The screw compressor with the adjustable internal volume ratio according to claim 1, wherein the slide valve comprises a second end disposed next to respective exhaust ends of the male rotor and the female rotor, and a radial exhaust port being configured at the second end of the slide valve.

4. The screw compressor with the adjustable internal volume ratio according to claim 3, wherein in the first position the first end extends outside the suction ends, while the second end does not extend outside the exhaust ends, and wherein in the second position the slide valve is entirely wrapped between the female rotor and the male rotor.

5. The screw compressor with the adjustable internal volume ratio according to claim 3, wherein in the third position, the first end extends outside the suction ends.

6. The screw compressor with the adjustable internal volume ratio according to claim 1, wherein the slide valve is driven by high pressure oil.

7. The screw compressor with the adjustable internal volume ratio according to claim 6, wherein the screw compressor with adjustable internal volume ratio comprises a hydraulic cylinder with an adjusting piston connected to the slide valve, wherein the adjusting piston is configured inside the hydraulic cylinder.

8. The screw compressor with the adjustable internal volume ratio according to claim 7, wherein the hydraulic cylinder is connected to an oil pipeline, which is connected to a suction cavity of the screw compressor, an upload magnetic valve and an unload magnetic valve being configured on the oil pipeline, and a first adjusting opening and a second adjusting opening being configured on the hydraulic cylinder, with the first adjusting opening and the second adjusting opening being connected to the magnetic valves.

9. The screw compressor with the adjustable internal volume ratio according to claim 1, wherein the length of the slide valve is determined by a maximum internal volume ratio designed for the screw compressor.

10. A screw compressor having an adjustable internal volume ratio, wherein the screw compressor comprises:

a body;

a male rotor;

a female rotor;

a slide valve inside the body; and a groove being configured at one side of the male rotor and the female rotor, wherein the slide valve is configured inside the groove, wherein the slide valve is able to move inside the groove from a first position corresponding to a minimum internal volume ratio to a second position corresponding to a maximum internal volume ratio, wherein the slide valve comprises a first end disposed next to respective suction ends of the male rotor and the female rotor and a second end disposed next to respective exhaust ends of the male rotor and the female rotor, wherein in the first position, the first end of the slide valve is longitudinally extended beyond the suction ends of the male rotor and the female rotor, and wherein in the second position, the first end of the slide valve is flush with the suction ends of the male rotor and the female rotor.

* * * * *